US005395655A

United States Patent [19]

Oyama Kazuyuki et al.

[11] Patent Number: 5,395,655

[45] Date of Patent: Mar. 7, 1995

[54] COMPOSITION AND PROCESS FOR CHROMATING METAL SURFACES

[75] Inventors: Oyama Kazuyuki; Norifumi Hatano; Akihiko Hasebe, all of Kanagawa, Japan

[73] Assignee: Henkel Corporation, Plymouth Meeting, Pa.

[21] Appl. No.: 66,151

[22] PCT Filed: Nov. 26, 1991

[86] PCT No.: PCT/US91/08890

§ 371 Date: Aug. 27, 1993

§ 102(e) Date: Aug. 27, 1993

[30] Foreign Application Priority Data

Nov. 28, 1990 [JP] Japan ..... 2-323228

[51] Int. Cl.[6] ..... B05D 3/02

[52] U.S. Cl. ..... 427/388.4; 148/251; 148/253; 148/258; 427/435; 524/5; 524/460

[58] Field of Search ..... 148/251, 253, 258; 427/388.4, 435; 524/5, 460

[56] References Cited

U.S. PATENT DOCUMENTS

| | | | |
|---|---|---|---|
| 4,341,878 | 7/1982 | Marcantonio et al. | 427/388.4 X |
| 4,647,316 | 3/1987 | Prescott | 148/6.16 |
| 4,650,527 | 3/1987 | Ishii et al. | 148/6.16 |
| 5,112,413 | 5/1992 | Carey et al. | 427/388.4 X |

FOREIGN PATENT DOCUMENTS

| | | |
|---|---|---|
| 0155742 | 9/1985 | European Pat. Off. . |
| 2550551 | 2/1985 | France . |

OTHER PUBLICATIONS

Patent Abstracts of Japan vol. 8, No. 11 (C-205) (1448) Jan. 18, 1984.

Patent Abstracts of Japan vol. 13, No. 84 (C-572) (3434) Feb. 27, 1989.

Patent Abstracts of Japan vol. 13, No. 336 (C-623) (3684) Jul. 27, 1989.

*Primary Examiner*—Michael Lusignan

*Attorney, Agent, or Firm*—Ernest G. Szoke; Wayne C. Jaeschke; Norvell E. Wisdom, Jr.

[57] ABSTRACT

A chromating treatment composition particularly suitable for preparing aluminum and stainless steel for clear coating comprises water, anions containing hexavalent chromium, trivalent chromium cations, phosphate ions, dry process finely divided silica, and acrylic and/or methacrylic acid polymer or copolymer in such amounts that:

(A) the concentration of the total of hexavalent and trivalent chromium atoms is in the range from 1 to 60 g/L;

(B) the (trivalent chromium atom)/(hexavalent chromium atom) weight ratio is in the range from 0.6 to 2.5;

(C) the (phosphate ion)/(total chromium atoms in hexavalent chromium ions and trivalent chromium ions) weight ratio is in the range from 0.5 to 4.5;

(D) the (dry process silica)/(total chromium atoms in hexavalent chromium ions and trivalent chromium ions) weight ratio is in the range from 0.1 to 5.0; and (E) the ratio of the weight of the specified water soluble polymer in the composition to the weight of the chromium atoms in the total of the hexavalent chromium ions and trivalent chromium ions in the composition is in the range from 0.01 to 1.0.

9 Claims, No Drawings

COMPOSITION AND PROCESS FOR CHROMATING METAL SURFACES

TECHNICAL FIELD

The present invention relates to a chromate treatment composition and process of using it. The composition is particularly well suited to forming a base or undercoating for a clear (substantially transparent) subsequent organic based overcoating on any metal surface, most particularly aluminum and stainless steels.

BACKGROUND ART

Numerous examples have appeared in recent years of the execution of clear coatings on metals (typically aluminum and stainless steel) for the purpose of producing a film which resists fingerprints, corrosion, and weathering and which simultaneously exploits the glossy appearance of the metal substrate. Clear coating in such cases has normally required a different type of undercoating or priming treatment from that optimized for underlying typical colored paints.

Colored paints generally contain sufficient pigment to hide the appearance of any priming or undercoating treatment used underneath them, so that the aesthetic impact of the substrate color generated by the undercoating treatment is a matter of little concern. However, in the case of clear coatings, the color of the undercoating treatment directly affects the post-painting appearance. In addition, it is highly desirable in the case of clear coatings to exploit the metallic texture of the coated metal. As a consequence, the undercoating treatment normally should be colorless or only very weakly colored. Moreover, clear coatings and color clear coatings usually impose limitations on the additives (pigments and the like) and employ special resins (e.g., fluorine containing resins) in contradistinction to colored paints, and as a result the known undercoating treatments in some cases may not provide a satisfactory adherence, corrosion resistance, and weather resistance.

Phosphating treatments and chromate treatments have been heretofore employed as undercoating treatments for metals which are to be painted.

Phosphating treatments are associated with the following two problems: limitations on the treatable metals, and reduction of the metal gloss due to the formation of a conversion film on the metal surface.

Chromate treatments are typically divided into the following 3 categories: reaction-type chromate treatments, electrolytic chromate treatments, and application- or coating-type chromate treatments. Reaction-type chromate treatments suffer from limitations on the treatable metals and from the general inability to avoid the coloration problem. Thus, when the associated coloration is reduced by limiting the film weight, the corrosion resistance and paint adherence become unsatisfactory because the film weight is then no longer adequate for these purposes.

Limitations on the applicable metals are not encountered in the case of electrolytic chromate treatments, but this type of treatment has not generally provided a satisfactory corrosion resistance. Application-type chromate treatments are not limited with regard to applicable metals and provide a relatively good post-painting performance with typical colored paints. However, conventional appli-cation-type chromate treatments cannot avoid the coloration problem, and conventional application-type chromate treatments often give an unsatisfactory paint adherence with the fluorine-type paints used for contemporary clear coatings. This led to an examination of the application-type chromate treatments which have been disclosed in the patent literature.

Included among these are, for example, the treatments proposed in Japanese Patent Application Laid Open [Kokai or Unexamined] Number 62-270781 [270,781/87] and Japanese Patent Application Laid Open Number 63-270480 [270,480/88]. Japanese Patent Application Laid Open Number 62-270,781 does not give a satisfactory basis for the clear coating art; coloration is still a problem because it employs a (trivalent chromium)/(hexavalent chromium) weight ratio in the range of 0.2 to 1.0. Furthermore, its paint adherence remains unsatisfactory. On the other hand, while Japanese Patent Application Laid Open Number 63-270480 is silent with regard to clear coatings, it nevertheless provides improvement with regard to post-treatment appearance and post-painting performance. However, this method places emphasis on obtaining a transparent whiteness for the post-treatment appearance in the case of no subsequent painting, and it requires the addition of an inorganic colloidal compound (silica sol or alumina sol). As a result, problems still remain with the paint adherence and the long term durability after painting.

In addition to these processes, other tactics include the application of paint after only a degreasing step and the use of silane coupling agent in the undercoating treatment (an example of the latter is Japanese Patent Publication Number 63-35712 [35,712/88]). No coloration problem is encountered in either approach, but the former approach suffers from an unsatisfactory paint adherence, corrosion resistance, and weather resistance while the latter approach suffers from an unsatisfactory corrosion resistance and weather resistance, although it does have an effect on the paint adherence.

DESCRIPTION OF THE INVENTION

Problem to Be Solved by the Invention

The present invention takes as its major object the provision of a chromate treatment composition (also called "bath" for brevity) which produces a conversion coating that is not only almost colorless, but also exhibits an excellent paint adherence, corrosion resistance, and weather resistance.

SUMMARY OF THE INVENTION

It has been found that an excellent paint adherence could be obtained through the addition of dry process silica and water soluble carboxyl containing polymer to a composition containing both hexavalent and trivalent chromium and by limiting the weight ratios of silica and polymer relative to total chromium (sum of trivalent chromium ions and chromium content of hexavalent chromium ions) to within specific, suitable ranges. The addition of only silica or only water soluble carboxyl containing polymer does affect the paint adherence to some degree, but the addition of both provides a remarkable improvement in the paint adherence.

The chromate treatment bath obtained based on the preceding comprises, more preferably consists essentially of, or most preferably consists of water and from 1 to 60 g/L total chromium (total as chromium atoms for hexavalent chromium ions plus trivalent chromium ions), phosphate ions, dry process silica, and water soluble carboxyl containing polymer, with the following limits on ratios among the various constituents:

- a (trivalent chromium atom)/(hexavalent chromium atom) weight ratio in the range from 0.6 to 2.5,
- a (phosphate ion)/(total chromium atoms in hexavalent chromium ions and trivalent chromium ions) weight ratio in the range from 0.5 to 4.5,
- a (dry process silica)/(total chromium atoms in hexavalent chromium ions and trivalent chromium ions) weight ratio in the range from 0.1 to 5.0, and
- a (water soluble carboxyl containing polymer)/(total chromium atoms in hexavalent chromium ions and trivalent chromium ions) weight ratio in the range from 0.01 to 1.0.

DETAILS OF PREFERRED EMBODIMENTS OF THE INVENTION

The treatment bath under consideration can be prepared as follows: Chromic anhydride and phosphoric acid are dissolved in water, part of the hexavalent chromium ion is then reduced to trivalent chromium ion using a reductant, and the dry process silica is subsequently dispersed in the bath and the water soluble carboxyl containing polymer is dissolved in the bath. The specific technique for preparing the treatment bath should be selected as appropriate. The chromic anhydride can be replaced by dichromate, chromate, or any other water soluble hexavalent chromium containing substance. The phosphoric acid can be replaced by other phosphate ion containing compounds, such as the polyphosphoric acids, ammonium phosphate, etc. (The stoichiometric equivalent as phosphate ions of any type of phosphorus containing anions or acids present is considered as the total phosphate for the purpose of calculating the ratios specified above.) The reductant may be selected as appropriate from compounds which exhibit a reducing activity, such as hydrogen peroxide, alcohols such as methanol and the like, polyvinyl alcohol, starch, tannic acid, hydrazine, etc.

Suitable silicas comprise dry process silicas with an average primary particle diameter of 7 to 100 nm. The use of wet process silica (silica sol) as the silica tends to result in blistering in post painting water resistance testing, although the post-treatment appearance will normally be clear.

The water soluble carboxyl containing polymer is selected from the polymers and copolymers of acrylic acid and methacrylic acid. Suitable polymers of this type are commercially available.

The bases for the restrictions imposed on the composition of the chromate treatment bath of the present invention are considered below.

A total chromium concentration less than 1 g/L cannot usually produce an adequate film weight, and the corrosion resistance, adherence, and weather resistance will be inferior as a result. When 60 g/L is exceeded, the film weight becomes too large and the color becomes noticeable. When the (trivalent chromium atoms)/(hexavalent chromium atoms) weight ratio falls below 0.6, the resulting film takes on noticeable color because too much hexavalent chromium ion is present. When this ratio exceeds a value of 2.5, the corrosion resistance will be inferior because too little hexavalent chromium ion is present. When the (phosphate ion)/(total chromium atoms) weight ratio is less than 0.5, the film assumes a noticeable color. On the other hand, the secondary adherence and weather resistance will be poor when this ratio takes on values in excess of 4.5.

When the (silica)/(total chromium) ratio is less than 0.1, the film's primary and secondary adherence will be inferior because an adequate silica add-on will not be obtained. When this ratio assumes values in excess of 5.0, the primary and secondary adherence will be inferior due to the presence of too much silica.

With respect to the (water soluble carboxyl containing polymer)/(total chromium) weight ratio, values less than 0.01 result in an unsatisfactory primary and secondary adherence while values in excess of 1.0 result in an inferior secondary adherence and weather resistance.

Film formation using the treatment bath according to the present invention will now be considered. This treatment bath is preferably applied or coated so as to produce on the clean metal surface a conversion coating containing from 5 to 60 milligrams of chromium metal per square meter of surface treated (hereinafter abbreviated as "$mg/m^2$"), and this is followed by drying without a water rinse and then preferably by application of the particular clear coating desired. The application method is suitably selected from such methods as roll coating, immersion coating, and wringer roll coating.

The treatment bath under consideration is superbly qualified for use within the realm of clear coating, but of course it can also be used as an undercoating for ordinary pigmented paints.

The present invention will be explained below in greater detail through illustrative, non-limiting examples and comparison examples.

EXAMPLES AND COMPARISON EXAMPLES

(1) Preparation of the chromate treatment baths

Example 1

50 grams ("g") of chromic anhydride and 41 g of phosphoric acid (75% aqueous solution) were dissolved in 500 g of water. This aqueous solution was reduced with starch to a (trivalent chromium atoms)/(hexavalent chromium atoms) weight ratio of 1:1. 50 grams of dry process silica (AEROSIL TM 200 from Nippon Aerosil Kabushiki Kaisha) was then dispersed into this bath, followed by dissolution into the dispersion thus obtained of 25 g of polyacrylic acid (JULYMER-AC-10H TM (20% solids) from Nippon Junyaku Kabushiki Kaisha). The treatment bath was subsequently brought to a total of 1 liter ("L") by the addition of water.

Example 2

A treatment bath was prepared as in Example 1, but in this case using polymethacrylic acid (JULYMER-AC-30H TM {20% solids} from Nippon Junyaku Kabushiki Kaisha) instead of the polyacrylic acid.

Examples 3 to 12

Treatment baths were prepared as in Example 1, but using the respective component quantities given in Table 1.

Comparison Examples 1 to 10

Treatment baths were prepared as in Example 1, but using the component quantities reported in Table 1.

Comparison Example 11

A treatment bath was prepared as in Example 1, but in this case replacing the dry process silica with a wet process silica (SNOWTEX TM O {20% solids} from Nissan Chemical Industries, Ltd.).

(2) Processing of the Test Samples

The chromate coating baths prepared as above were each applied by roll coating to the surface of aluminum (Type A3005) and stainless steel sheet (Type SUS304) using the process sequence outlined below:

Alkaline degreasing→water rinse→roll squeegee→drying→chromate application→roll squeegee→drying (without rinsing)→painting→baking.

TABLE 1

| | Composition of the treatment baths | | | | | | | | | |
|---|---|---|---|---|---|---|---|---|---|---|
| | total chromium g/L | hexavalent chromium g/L | trivalent chromium g/L | phosphate ion g/L | silica g/L | water-soluble polymer g/L | $Cr^{3+}/Cr^{6+}$ | phosphate ion/ total Cr | dry-method silica/ total Cr | water-soluble polymer/ total Cr |
| example | | | | | | | | | | |
| 1 | 26 | 13 | 13 | 30 | dry-method 50 | PAA 5 | 1.00 | 1.15 | 1.92 | 0.19 |
| 2 | 26 | 13 | 13 | 30 | dry-method 50 | PMA 5 | 1.00 | 1.15 | 1.92 | 0.19 |
| 3 | 52 | 26 | 26 | 60 | dry-method 100 | PAA 5 | 1.00 | 1.15 | 1.92 | 0.19 |
| 4 | 5 | 2.5 | 2.5 | 6 | dry-method 10 | PAA 1 | 1.00 | 1.20 | 2.00 | 0.20 |
| 5 | 26 | 16 | 10 | 30 | dry-method 50 | PAA 5 | 0.63 | 1.15 | 1.92 | 0.19 |
| 6 | 26 | 8 | 18 | 30 | dry-method 50 | PAA 5 | 2.25 | 1.15 | 1.92 | 0.19 |
| 7 | 26 | 13 | 13 | 110 | dry-method 50 | PAA 5 | 1.00 | 4.23 | 1.92 | 0.19 |
| 8 | 26 | 13 | 13 | 15 | dry-method 50 | PAA 5 | 1.00 | 0.58 | 1.92 | 0.19 |
| 9 | 26 | 13 | 13 | 30 | dry-method 100 | PAA 5 | 1.00 | 1.15 | 3.85 | 0.19 |
| 10 | 26 | 13 | 13 | 30 | dry-method 5 | PAA 5 | 1.00 | 1.15 | 0.19 | 0.19 |
| 11 | 26 | 13 | 13 | 30 | dry-method 50 | PAA 20 | 1.00 | 1.15 | 1.92 | 0.77 |
| 12 | 26 | 13 | 13 | 30 | dry-method 50 | PAA 1 | 1.00 | 1.15 | 1.92 | 0.04 |
| comparison example | | | | | | | | | | |
| 1 | 100 | 50 | 50 | 115 | dry-method 192 | PAA 20 | 1.00 | 1.15 | 1.92 | 0.20 |
| 2 | 0.5 | 0.25 | 0.25 | 0.6 | dry-method 1 | PAA 0.1 | 1.00 | 1.20 | 1.92 | 0.20 |
| 3 | 26 | 6 | 20 | 30 | dry-method 50 | PAA 5 | 3.33 | 1.15 | 1.92 | 0.19 |
| 4 | 26 | 20 | 6 | 30 | dry-method 50 | PAA 5 | 0.30 | 1.15 | 1.92 | 0.19 |
| 5 | 26 | 13 | 13 | 150 | dry-method 50 | PAA 5 | 1.00 | 5.77 | 1.92 | 0.19 |
| 6 | 26 | 13 | 13 | 10 | dry-method 50 | PAA 5 | 1.00 | 0.38 | 1.92 | 0.19 |
| 7 | 26 | 13 | 13 | 30 | dry-method 130 | PAA 5 | 1.00 | 1.15 | 5.00 | 0.19 |
| 8 | 26 | 13 | 13 | 30 | dry-method 1 | PAA 5 | 1.00 | 1.15 | 0.04 | 0.19 |
| 9 | 26 | 13 | 13 | 30 | dry-method 50 | PAA 30 | 1.00 | 1.15 | 1.92 | 1.15 |
| 10 | 26 | 13 | 13 | 30 | dry-method 50 | PAA 0.1 | 1.00 | 0.96 | 0.96 | 0.004 |

TABLE 1-continued

| | Composition of the treatment baths | | | | | | | | | |
|---|---|---|---|---|---|---|---|---|---|---|
| | total chromium g/L | hexavalent chromium g/L | trivalent chromium g/L | phosphate ion g/L | silica g/L | water-soluble polymer g/L | $Cr^{3+}/Cr^{6+}$ | phosphate ion/ total Cr | dry-method silica/ total Cr | water-soluble polymer/ total Cr |
| 11 | 26 | 13 | 13 | 30 | wet-method 50 | PAA 5 | 1.00 | 1.15 | 1.92 | 0.19 |

PAA = polyacrylic acid
PMA = polymethacrylic acid

For the stainless Steel sheet, alkaline degreasing in the process sequence outlined above consisted of immersion for 1 minute in a 2% aqueous solution of FINECLEANER TM 4360 (from Nihon Parkerizing Company, Limited) at 60° C. For the aluminum, degreasing was by immersion for 1 minute in a 2% aqueous solution of FINECLEANER TM 315 (from Nihon Parkerizing Company, Limited) at 60° C.

For the aluminum, painting in the process sequence outlined above consisted of applying a 10 micron thick polyester clear coating; for stainless steel, it was a 10 micron thick, fluorine-type coating.

(3) Performance evaluation testing (a) appearance evaluation

The color was visually evaluated after clear coating and is reported according to the following scale:

++ no color
+ slight coloration
× coloration
×× substantial coloration (b) paint adherence Primary adherence The painted sheet was 0T-folded, peeled with cellophane tape, and the residual film was then visually evaluated.

Secondary adherence

The painted sheet was immersed in boiling water for 2 hours and then evaluated as for the primary adherence. Evaluation of both primary and secondary adherence was reported according to the following scale:

++ no film peeling
+ slight peeling over part of the surface
× peeling over part of the surface
×× substantial peeling (c) corrosion resistance A cut was scribed through the paint film to the base metal. This was followed by salt-spray testing for 2,000 hours (aluminum) or for 5,000 hours (stainless steel sheet). The development of rust at both the cut and over the entire surface was visually evaluated and reported according to the following scale:

++ no rusting
+ modest rusting over part of the surface
× rusting over part of the surface
×× substantial rusting (d) weather resistance The paint film was scribed with a cut through to the base metal, followed by exposure in a Sunshine Weather-O-Meter for 500 hours (aluminum) or for 2,000 hours (stainless steel sheet). Film exfoliation at both the cut and over the entire surface was then visually evaluated and reported according to the following scale.

++ no film exfoliation
+ slight exfoliation over part of the surface
× exfoliation over part of the surface
×× substantial exfoliation The test results are reported in Table 2. They confirm that the chromate baths according to the present invention have excellent properties for application as a preparation for clear coating.

TABLE 2

| | | Test Results | | | | |
|---|---|---|---|---|---|---|
| example | Cr add-on mg/m² | coating appearance | 1° adherence | 2° adherence | corrosion resistance | weather resistance |
| example | | | material stainless steel | | | |
| 1 | 30 | ++ | ++ | ++ | ++ | ++ |
| 2 | 30 | ++ | ++ | ++ | ++ | ++ |
| 3 | 60 | + | ++ | ++ | ++ | ++ |
| 4 | 6 | ++ | ++ | ++ | ++ | + |
| 5 | 30 | + | ++ | ++ | ++ | ++ |
| 6 | 30 | ++ | ++ | ++ | ++ | ++ |
| 7 | 30 | ++ | ++ | + | ++ | + |
| 8 | 30 | + | ++ | ++ | ++ | ++ |
| 9 | 30 | ++ | + | + | ++ | ++ |
| 10 | 30 | ++ | + | + | ++ | + |
| 11 | 30 | ++ | ++ | + | ++ | + |
| 12 | 30 | ++ | + | + | ++ | ++ |
| | | | material aluminum | | | |
| 1 | 30 | ++ | ++ | ++ | ++ | ++ |
| 2 | 30 | ++ | ++ | ++ | ++ | ++ |
| 3 | 60 | + | ++ | ++ | ++ | ++ |
| 4 | 6 | ++ | ++ | ++ | + | ++ |
| 5 | 30 | + | ++ | ++ | ++ | ++ |
| 6 | 30 | ++ | ++ | ++ | ++ | ++ |
| 7 | 30 | ++ | ++ | ++ | ++ | ++ |
| 8 | 30 | + | ++ | ++ | ++ | ++ |
| 9 | 30 | ++ | + | + | ++ | ++ |
| 10 | 30 | ++ | + | + | ++ | + |
| 11 | 30 | ++ | ++ | + | + | + |
| 12 | 30 | ++ | ++ | ++ | ++ | ++ |
| comparison example | | | material stainless steel | | | |
| | 115 | XX | + | + | ++ | + |
| 2 | 3 | ++ | XX | XX | + | XX |
| 3 | 30 | ++ | + | X | + | X |
| 4 | 30 | XX | + | + | ++ | + |
| 5 | 30 | ++ | X | XX | ++ | XX |
| 6 | 30 | X | + | + | ++ | + |
| 7 | 30 | ++ | X | X | ++ | + |
| 8 | 30 | ++ | X | X | ++ | X |
| 9 | 30 | ++ | + | XX | ++ | XX |
| 10 | 30 | ++ | X | X | ++ | X |
| 11 | 30 | ++ | X | XX | ++ | + |
| | | | material aluminum | | | |
| 1 | 115 | XX | + | + | + | + |
| 2 | 3 | ++ | XX | XX | XX | XX |
| 3 | 30 | ++ | ' | XX | XX | X |
| 4 | 30 | XX | + | + | + | + |
| 5 | 30 | ++ | XX | XX | XX | XX |

TABLE 2-continued

| | | Test Results | | | | |
|---|---|---|---|---|---|---|
| example | Cr add-on mg/m$^2$ | coating appearance | 1° adherence | 2° adherence | corrosion resistance | weather resistance |
| 6 | 30 | X | + | + | + | + |
| 7 | 30 | ++ | X | X | + | + |
| 8 | 30 | ++ | X | X | + | X |
| 9 | 30 | ++ | X | XX | X | XX |
| 10 | 30 | ++ | X | X | + | X |
| 11 | 30 | ++ | X | XX | + | + |

The invention claimed is:

1. A liquid composition consisting essentially of water, a source providing dissolved anions containing hexavalent chromium atoms, a source providing dissolved trivalent chromium cations, and a source of dissolved phosphate ions, and optionally, a reductant for hexavalent chromium, wherein the composition also contains dry process silica and water soluble polymer selected from the group consisting of polymers and copolymers of acrylic acid and methacrylic acid and:

(A) the concentration of the total of hexavalent and trivalent chromium atoms is in the range from 1 to 60 g/l;

(B) the (trivalent chromium atom)/(hexavalent chromium atom) weight ratio is in the range from 0.6 to 2.5;

(C) the (phosphate ion)/(total chromium atoms in hexavalent chromium ions and trivalent chromium ions) weight ration is in the range from 0.5 to 4.5;

(D) the (dry process silica)/(total chromium atoms in hexavalent chromium ions and trivalent chromium ions) weight ratio is in the range from 0.1 to 5.0; and (E) the ratio of the weight of the specified water soluble polymer in the composition to the weight of the chromium atoms in the total of the hexavalent chromium ions and trivalent chromium ions in the composition is in the range from 0.01 to 1.0.

2. A process for treating a metal surface, comprising contacting the metal surface with a liquid composition of matter according to claim 1 and subsequently drying the surface so contacted, without any intermediate rinsing between contacting and drying.

3. A process according to claim 2, wherein the metal treated is aluminum or stainless steel.

4. A process according to claim 3 in which the contacting is for a sufficient time to deposit a coating containing from 5 to 60 milligrams of chromium per square meter of metal surface treated.

5. A process according to claim 2 in which the contacting is for a sufficient time to deposit a coating containing from 5 to 60 milligrams of chromium per square meter of metal surface treated.

6. A process according to claim 5, comprising an additional step of covering the contacted and dried surface with a clear organic based protective coating.

7. A process according to claim 4, comprising an additional step of covering the contacted and dried surface with a clear organic based protective coating.

8. A process according to claim 3, comprising an additional step of covering the contacted and dried surface with a clear organic based protective coating.

9. A process according to claim 2, comprising an additional step of covering the contacted and dried surface with a clear organic based protective coating.

* * * * *

UNITED STATES PATENT AND TRADEMARK OFFICE

CERTIFICATE OF CORRECTION

PATENT NO. : 5,395,655

DATED : Mar. 7, 1995

INVENTOR(S) : Oyama Kazuyuki et al.

It is certified that error appears in the above-indentified patent and that said Letters Patent is hereby corrected as shown below:

On title page, under item [19] "Oyama Kazuyuki" should read --Oyama, et al-- and [75] Inventors, first inventor's name,

"Oyama Kazuyuki", should read:

-- Kazuyuki Oyama --.

Signed and Sealed this

Nineteenth Day of September, 1995

*Attest:*

Bruce Lehman

BRUCE LEHMAN

*Attesting Officer*

*Commissioner of Patents and Trademarks*